United States Patent [19]

Moore

[11] 4,041,750

[45] Aug. 16, 1977

[54] METHOD AND APPARATUS FOR PRODUCING SERRATED METAL BARS

[76] Inventor: Keith William Moore, 8 Burradool Street, West Wollongong, New South Wales, Australia

[21] Appl. No.: 667,167

[22] Filed: Mar. 15, 1976

[30] Foreign Application Priority Data

Oct. 10, 1975 Australia ..... 3418/75

[51] Int. Cl.[2] ..... B21B 1/12

[52] U.S. Cl. ..... 72/187; 72/234; 72/197

[58] Field of Search ..... 72/187, 234, 235, 197; 29/160

[56] References Cited

U.S. PATENT DOCUMENTS 1,636,592 7/1927 Cushwa ..... 29/160

1,773,836 8/1930 Woefel ..... 72/187

*Primary Examiner*—Lowell A. Larson

*Attorney, Agent, or Firm*—Jay L. Chaskin

[57] ABSTRACT

A method of producing a metal bar having one edge serrated wherein a billet work-piece of metal is heated and passed through stands of a hot rolling mill so as to elongate the billet into a bar and form the bar to a generally rectangular shape, supporting the side faces of the bar in a notching stand near the output end of the mill, supporting one edge of the work-piece in the notching stand by one roll of that stand, forming serrations in the other edge of the bar in the working zone by engaging that other edge with outstanding teeth of the second roll, and subsequently passing the work-piece through a further stand to flatten the work-piece side faces and size the work-piece.

10 Claims, 3 Drawing Figures

METHOD AND APPARATUS FOR PRODUCING SERRATED METAL BARS

This invention relates to the production of flat metal bars each having at least one edge serrated.

In large engineering plants such as oil drilling rigs, refineries and power stations, there is wide use of steel gratings as floors, the advantages being that they do not retain liquids such as oil or water, they permit vision between different levels, and provide ventilation.

Such gratings have been made in a number of forms, for example welded grids or expanded metal, but notwithstanding the mesh like construction the upper surfaces of the bars forming the mesh are sometimes flat and smooth, and, whilst affording some protection against transverse movement, do not prevent slippage of a foot along a bar.

For the above reasons the upper surfaces of some at least of the bars are frequently serrated to provide grip and prevent slip in at least a longitudinal direction along those bars.

Serrations are normally formed by the cold working of flat metal bars of rectangular cross section. There are two types of cold working which have been proposed. They are referred to herein as the "die cutting method" and the "cold forming method" respectively.

As far as is known to the applicants, the only methods generally in use is the die cutting method and the splitting of a strip by rollers having a centrally located shear which produces a castellated form on one edge of each bar, and in the die cutting method elongate flat workpieces of rectangular bar have the required serrations formed by passing the bar through a set of dies in a press which punch out half-round portions from the metal work-piece to form notches extending inwardly from one edge thereof. Since the bars are usually quite thick (in the order of 5mm) the dies are of heavy or rugged construction and can cut only a few notches at a time. It is usual to cut about eight notches at the one time, although it is known that very heavy machines have been employed which can cut as many as twenty notches at once. However the operation is still very slow, having regards to the requirement to cut in excess of 2000 notches for average grating having an area of one square meter. Furthermore, a further station is required in a factory to achieve this cutting, and it is necessary to store the flat work-pieces, remove the work-piece from the store, pass them through the notching machine, and re-stack before the work-pieces are utilised in the production of grating. One object of this invention is to provide a production method which is much faster than that referred to above.

The very slow nature of the notching operation has been well recognised in the art, and it is known that propositions have been put forward which are designed to increase the operation speed. Thus for example in the specification which accompanied the Tishken U.S. Pat. No. 3,646,794 there was described method of notching by cold deformation of the upper edge of a work-piece. The work-piece was shown to be passed between a pair of driven rolls one of which was provided with a plurality of notch forming teeth on its periphery, such that a series of transverse, adjacently grooved portions were formed on one edge of the work-piece. However it is still necessary with the Tishken process to have a separate station and to separately handle the bars after they have been formed to a flat rectangular shape.

In the specification which accompanied the companion U.S. Pat. No. 3,653,245, Tishken accurately disclosed the need to utilise very robust equipment. This was of course necessary because of the immense forces required to cause metal flow in cold forming of steel. Accordingly it will be seen that the Tishken method would also be costly, involving high capital expenditure for the necessary equipment. Furthermore, the rate of cold forming of metal is essentially slow when compared with hot rolling, and still further a difficulty is encountered when serrations are formed by cold forming metal in that the metal lines of flow result essentially in rounded corners between the land areas and the walls defining the notches. Such rounded corners are not desirable characteristics of the serrations of grating bars.

Other prior art includes formation of nut blank by hot working of steel, but in this art, a length of steel is heated in a furnace and passed relatively slowly between rollers which deform it into hexagonal or other shapes. It is believed to be impossible to form nut blanks at hot rolling speeds which exceed one thousand feet (300 meters) a minute, owing to the tendency of the plastic metal to "iron out" deformation transverse of its direction of travel, and to lose sharpness of shape.

BRIEF SUMMARY OF THE INVENTION

It is known in the hot rolling of steel to form transverse deformations in certain instances. However many difficulties are encountered and because of these difficulties, the hot rolling of deformation in edges of flat bars is not known. One of the difficulties which has to be overcome to achieve such deformation is the prevention of asymmetrical upsetting of the metal, since it is found that to form transverse notches in the serrating of a bar, a great deal of metal upset is required.

The invention may be summarised as a method of producing a metal bar having one edge serrated wherein a billet workpiece of metal is heated and passed through stands of a hot rolling mill so as to elongate the billet into a bar and form the bar to a generally rectangular shape, supporting the side faces of the bar in a notching stand near the output end of the mill with support surfaces which extend close to the working zone, supporting one edge of the workpiece remote from the working zone in the notching stand by one roll of that stand, and forming serrations in the other edge of the bar in the working zone by engaging that other edge with outstanding teeth of the second roll, and subsequently passing the work-piece through a further stand to flatten the work-piece side faces and size the workpiece.

More specifically, the invention may be defined as being characterised by supporting the side faces of a rectangular bar in a notching stand near the output end of a hot rolling mill with support surfaces which extend to a locality adjacent a working zone, supporting an edge of the workpiece remote from the working zone with a first roll of the notching stand, forming serrations in the other edge of the bar in the working zone while it is still in its hot and plastic state by engaging that other edge with outstanding teeth of a second co-operating roll, and passing the work-piece through a further stand and between co-operating rolls of that further stand which engage and flatten the work-piece side faces to a thickness which is determined by the space between said further stand rolls.

Contrary to former opinion, we have found that it is possible to form serrations in one edge of a flat bar (say for example five times as wide as it is thick) in the hot roll mill provided the side faces of the bar are supported with support surfaces which extend to a locality adjacent the working zone, that is adjacent the edge in which the notches are being formed. It is found to be essential that the support surfaces be as close as is reasonably possible to the notching roll, and the space between the crowns of the notching roll teeth and the support means should not exceed one half the thickness of the flat metal bar at that stage through the hot roll mill. This overcomes a difficulty otherwise found to be encountered of asymmetrical upsetting of the material which is difficult to correct in further stands.

One means for supporting the side faces of the bar constitutes passing the bar through a groove in the periphery of the support roll in the notching stand, the groove walls being almost as deep as the work-piece after it has been notched. Desirably the groove walls are more nearly parallel and very much deeper than groove walls of prior art rolls, and to facilitate lead in, the outer surfaces of the groove walls are provided with compound curves or a "bell mouth" shape.

Another difficulty which is encountered in the formation of notches by the teeth of a roller is the tendency for the metal to become curved on all edges, this being particularly so when the metal is cold. We have found however that by careful attention to the cross-sectional shape of the teeth on the roll at the notch forming stand, it is possible to achieve a relatively sharp corner between the surface of a notch and the extremity of a land, and that this sharpness is not lost in a subsequent flattening operation. Thus in an aspect of the invention, the notch forming stand is provided with a toothed roller each tooth of which has walls which converge in a radially outward direction from a circular periphery of the roller, the walls terminating in a curved crown. Particularly, it is found that if each wall defines with a radial line an angle of between 15 and 25° , the angle between the land of the work-piece and the wall of each notch is relatively sharp and the work-piece is an acceptable product for use in bar grating where non-slip characteristics are important.

In a further aspect of the invention, the deformation (reduction in bar width) at the notch forming stand is very much greater than is achieved in the normal "edging" of a flat bar in the normal hot rolling process, and for example with a bar 6 millimeters thick, a deformation of at least 4 millimeters in width is necessary to achieve serrations of satisfactory depth and sharpness.

One of the tendencies of a work-piece after passing through a hot roll stand is to have side edges become convex, or bulge, and in a further aspect of the invention at least one of the stands traversed by the work-piece before entering the notch forming stand is provided with rolls having grooves the root surfaces of which are convex. This results in a concave surface on each edge of the work-piece which to some extent compensates for the tendency of that edge to be formed to a convex shape and maintains some degree of sharpness at the extremities of the land area between adjacent notches.

Further, in order to reduce the tendency of the metal flow to cause the serrations to become a more sinusoidal shape which will not provide the required degree of grip for bar grating, it is deemed necessary to form the notches at a temperature of between 900° and 1000° C. If the temperature is allowed to drop below 900° C., there is a risk of loss of sharpness in a carbon steel, for example a mild steel.

BRIEF DESCRIPTION OF THE DRAWINGS

An embodiment of the invention is described hereunder in some detail with reference to and as illustrated in the accompanying drawings in which.

DETAILED DESCRIPTION OF THE PREFERRED EMBODIMENT ILLUSTRATED IN THE DRAWINGS

Figure 1:
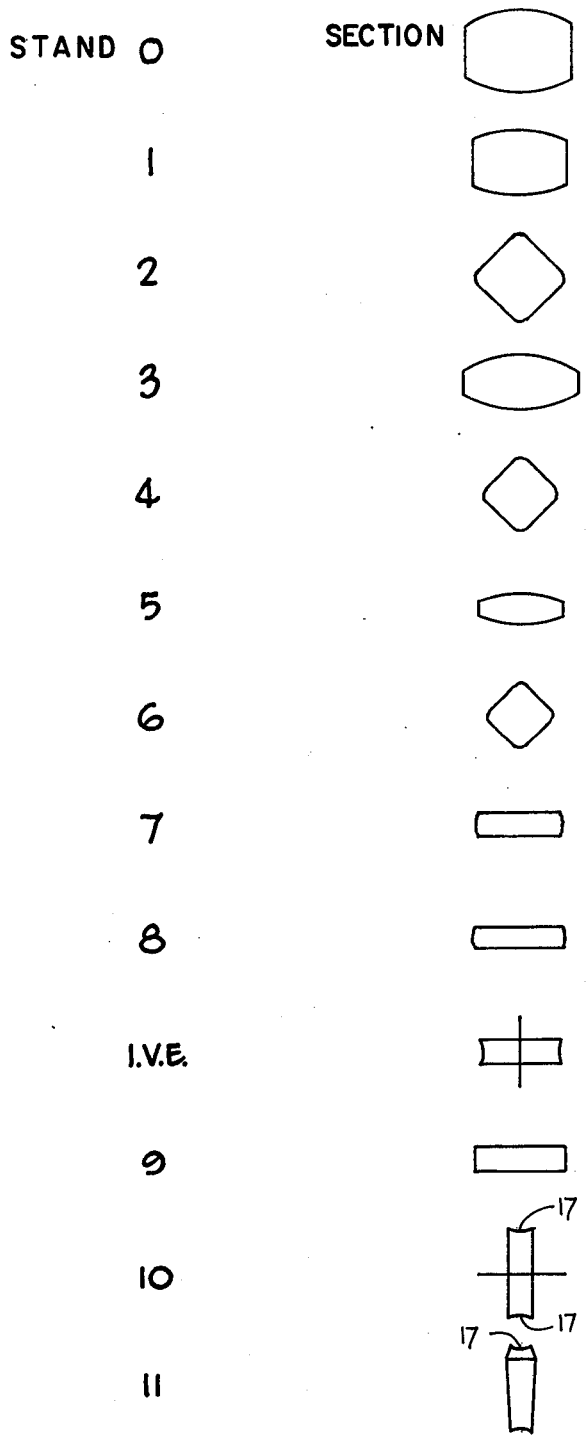
FIG. 1 is a diagrammatic representation showing the change of shape which occurs in each of the stands of a thirteen stand rolling mill wherein the notch forming rolls re in the penultimate stand.

In its preferred form which is illustrated in the drawings, this embodiment utilises a hot rolling merchant mill which comprises a heating furnace (not shown) and a series of fourteen sets of rolls disposed as pairs in multiple stands and arranged in sequence. The stands are designated 0 through to 12 in FIG. 1, and the corresponding sections are drawn alongside the stands. The stand marked with the letters I.V.E. is an intermediate vertical edging stand having rollers which function to impart the concavity 17 to the bar edges and size the bar width. Stand I.V.E. is separately designated because it is not a normal stand of the hot roll mill described herein.

The sets of rolls all of which are driven are arranged with their axes parallel and in the horizontal plane and are supported in journals to facilitate rotation, except for the additional stand I.V.E. which has the roll axes vertical. In this embodiment of the invention, the notch forming rolls are the penultimate pair of rolls at stand 11, and these comprise a grooved roll 15 and a toothed roll 16 which are depicted to an enlarged scale in FIGS. 2 and 3 wherein the work-piece is shown passing through the rolls.

When the work-piece enters stand 11, it encounters a much deeper groove than is normally used for rolling. The groove is so deep that there is only two millimeters clearance between the periphery of the grooved roll 15 and the crowns of the teeth of the toothed roll 16, extending almost to the working zone wherein the notches are formed in the work-piece.

The side walls of the groove 18 are frusto-conical at their radially inner portions, but the divergence increases towards the mouth of the groove 18 where the groove has a compound curve. However even the frusto-conical portions 18 diverge less than corresponding grooves at previous stands (for example stand 10) the divergence in this embodiment being from 4° to 6° included angle, that is, two degrees to three degrees each side of a radial plane. The groove side walls form the support surfaces for the side faces of the bar. It may be noted also that the root 19 of the groove 18 is convex, thereby retaining the concavity in the lower surface of the work-piece which is designated 20.

Figure 2:
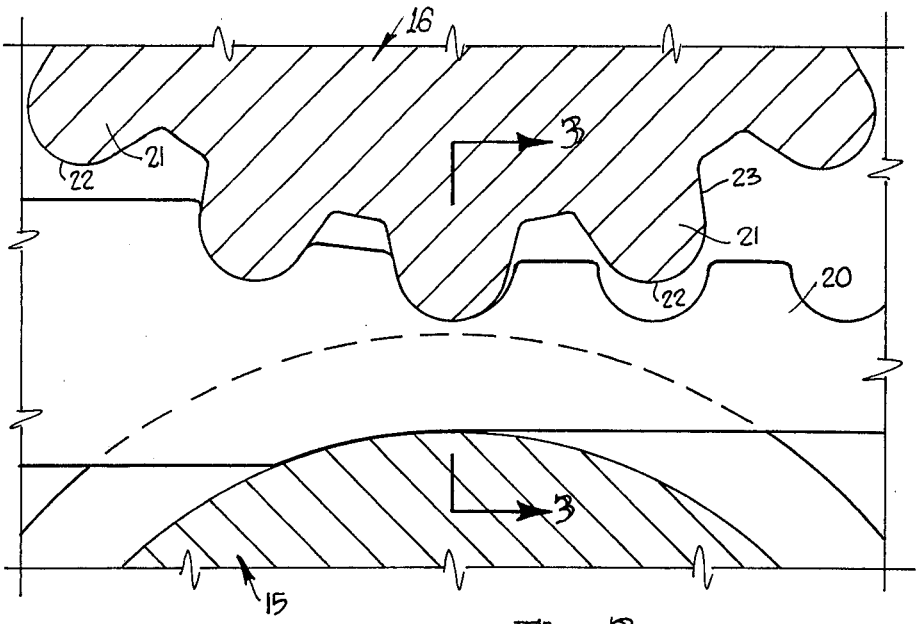
FIG. 2 is a longitudinal section drawn to an enlarged scale and illustrating the notch forming operation.

As shown in FIG. 2, there is a very considerable reduction in depth of the work-piece as it passes between the grooved roll 15 and the toothed roll 16, it being found essential to have a minimum of 4 mm. reduction in depth, and that is to the top of the metal serration between the notches formed by the teeth 21 of the toothed roll 16. It will be noted from FIG. 2 that the work-piece does not encounter the root surface of the roll 16 between the teeth 21.

Since the work-piece is transversing stand 11 at very high speeds, in excess of 1000 ft. (300 m.) per minute, the tooth profile is of utmost importance, and it will be noted that each tooth 21 has a cross sectional shape which includes an arcuate crown 22 flanked on each side by a substantially flat wall portion 23, and it will be seen that the wall portions 23 converge towards one another radially outwardly and toward the crown 22. Each flat wall portion defines an angle of 20° with a radial line, that is, the included angle between the flat wall portions of each tooth is 40° , in this embodiment. It is found that this configuration forms a substantially arcuate profile notch in the workpiece 20, and that the edges between the land and notch wall remain sufficiently sharp to provide a good grip for a foot of a person utilising a grating subsequently made with the serrated bar. This grip is considerably improved by the concavity which remains in the upper surfaces of the workpiece serration after the work-piece leaves stand 11, and with this configuration the land area extremities form an arris, or burr-like shape.

Figure 3:
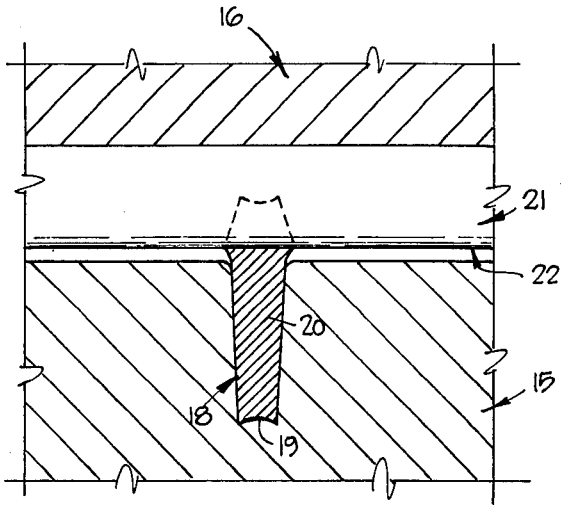
FIG. 3 is a fragmentary transverse section taken on line 3—3 of FIG. 2.

As illustrated in FIG. 3, where the metal is displaced by the teeth 21 in the working zone, there is some transverse displacement which is arrested by the side walls of the annular groove 18 in the roll 15. The illustrated configuration, combining as it does the bell mouth shaped groove and the close proximity of the roll surface to the teeth, is found to be effective in preventing asymmetrical upsetting of the metal of the work-piece. The working diameter of the toothed roll 16 is approximately the outer diameter of the teeth. This should be approximately equal to the working diameter of the grooved roll 15, that is, the base of the groove, but need not be identical. Thus a single grooved roll 15 may have several grooves for bars of varying widths. Since the pitch is subject to variation because of the plastic state of the metal as it passes through the notch forming stand, it is necessary to effect the whole of the serration of the work-piece in a single stand and this is achieved by the very considerable interference with the work-piece by the rolls.

In the embodiment described the metal is a mild steel, that is a steel having a low carbon content, less than 0.25%. With the low carbon mild steel referred to herein, the billet is initially "soaked" in a furnace at such a temperature that the billet has a temperature of about 1100° C. as it enters the first stand, stand 0. However when it reaches stand 11 the temperature lies between 900° and 1000° C., and it is at this temperature that the best results are obtained with respect to sharpness.

The invention is of course limited to hot workable metal, since some metals are not suitable for hot rolling, for example some bronzes are "hot short" and are completely unsuited to this invention.

Owing to the cross sectional shape being deformed as illustrated in FIG. 3, the work-piece requires flattening to become a suitable member for use in a grating, and it is achieved by twisting the work-piece between stands 11 and 12 so that it lies "on flat" before it reaches the final (sizing) stand, stand 12, where it passes between plain surfaced rolls which return its side walls to be parallel.

The work-piece is then cropped to length and is ready for assembly into a grating without further machine operations.

The invention is not limited to the type of merchant mill described above, wherein most rolls have horizontal axes, but can be achieved in a mill wherein some rolls are vertical.

If the teeth on roll 16 extend across the full face, and different portions of the teeth can be made use of at different times (for example if wear takes place) by replacing roll 15 with another roll having its groove located at a different position.

We have found that the use of edging rolls in the stand preceding the penultimate or notch-forming stand, while not essential, does produce a product in which the serrations formed in one edge are sharp and therefore more acceptable.

While the invention has been described specifically in relation to the hot rolling of mild steel in a merchant mill, the invention may be equally applicable to the other metal/mill combinations.

I claim:

1. A method of producing flat metal bars each having at least one edge serrated, comprising passing a billet workpiece of hot metal which has hot roll characteristics through a series of stands of cooperating rolls in a hot roll mill, so as to elongate the billet into a bar and form the bar to a generally rectangular shape, passing the workpiece through a groove in a roll in a notching stand at a high speed, said groove having a root wall, and side walls which diverge outwardly and curve away from one another towards the groove mouth to define between them a bell-mouth shape in cross-section, said mouth being at a locality adjacent a working zone, supporting one edge of the work-piece remote from the working zone by said groove root, forming serrations in the other edge of the bar in the working zone while it is still in its hot and plastic state by engaging that other edge with outstanding teeth of a second co-operating roll, while at the same time deforming the workpiece within the groove to have its side faces contiguous with said groove side walls and to be supported thereby and passing the workpiece through a further stand and between cooperating rolls of that further stand which engage and flatten the workpiece side faces to a thickness which is determined by the space between said further stand rolls.

2. A method according to claim 1 wherein deforming of the workpiece in the groove provides side faces which subtend an angle of about four degrees with each other.

3. A method according to claim 1 wherein the workpiece in passing through the notching stand is passed between said rolls thereof when arranged with the minimum space between the periphery of the first said roll and said teeth being less than one half the work-piece thickness as it enters said stand.

4. A method according to claim 1 further comprising forming the edges of the rectangular shape billet concave by passing them between rolls, the root surfaces of which are convex, before the billet enters said notch forming stand.

5. A method according to claim 1 further comprising forming said serrations with outstanding teeth each of which in cross-section is curved at its crown, and has its curved crown flanked with walls which converge towards said crown.

6. A method according to claim 5 wherein the converging walls of each tooth defines between them an included angle of between 30° and 50°.

7. A method according to claim 1 wherein said metal bar is mild steel, and further comprising passing the bar through said notch forming stand at a temperature of between 900° C. and 1000° C.

8. A notch forming stand in a mill for producing a metal bar having one edge serrated, comprising two spaced driven rolls, one said rolls having an annular groove extending around it defined by a root wall and a pair of diverging side walls the divergence of which increases at the groove mouth to define between them a bell-mouth shape in cross-section, the other said roll having outstanding teeth theron each of which extends across the face of the roll, is curved at its crown, and is flanked with walls which converge towards the curved crown, the minimum space between the periphery of the first said roll and a tooth crown of the second said roll being less than one half the minimum width of said groove.

9. A notch forming stand according to claim 8 wherein the converging walls of each tooth define between them an including angle of between 30° and 50°.

10. A notch forming stand according to claim 8 wherein the diverging side walls define between them an included angle of between about 4° to 6°.

* * * * *